US010619368B2

(12) United States Patent
Steinbauer et al.

(10) Patent No.: US 10,619,368 B2
(45) Date of Patent: Apr. 14, 2020

(54) MODULAR AND MULTIPURPOSE COVERING DEVICE FOR A POOL SUCH AS A SWIMMING POOL OR THE LIKE

(71) Applicant: Groupe Waterair, Seppois le Bas (FR)

(72) Inventors: Thierry Steinbauer, Giromagny (FR); Luc Meheux, Bethoncourt (FR)

(73) Assignee: Groupe Waterair (FR)

( * ) Notice: Subject to any disclaimer, the term of this patent is extended or adjusted under 35 U.S.C. 154(b) by 0 days.

(21) Appl. No.: 16/324,474

(22) PCT Filed: Aug. 3, 2017

(86) PCT No.: PCT/EP2017/069730
§ 371 (c)(1),
(2) Date: Feb. 8, 2019

(87) PCT Pub. No.: WO2018/033407
PCT Pub. Date: Feb. 22, 2018

(65) Prior Publication Data

US 2019/0169868 A1 Jun. 6, 2019

(30) Foreign Application Priority Data

Aug. 17, 2016 (FR) ..... 16 57787

(51) Int. Cl.
*E04H 4/08* (2006.01)
*E04H 4/10* (2006.01)

(52) U.S. Cl.
CPC ..... *E04H 4/082* (2013.01); *E04H 4/10* (2013.01)

(58) Field of Classification Search
CPC ..... E04H 4/082; E04H 4/08
USPC ..... 4/498
See application file for complete search history.

(56) References Cited

U.S. PATENT DOCUMENTS

2003/0177570 A1* 9/2003 St-Hilaire ..... E04H 4/10 4/498

FOREIGN PATENT DOCUMENTS

| | | | |
|---|---|---|---|
| EP | 0570311 | 11/1993 | |
| EP | 0570311 A1 * | 11/1993 | ..... E04H 4/101 |
| EP | 1564347 | 8/2005 | |
| EP | 2374964 | 10/2011 | |
| EP | 2623691 | 8/2013 | |

* cited by examiner

*Primary Examiner* — Lauren A Crane
(74) *Attorney, Agent, or Firm* — Forge IP, PLLC

(57) ABSTRACT

A modular and multipurpose covering device for a pool includes a first modular covering tarpaulin forming a tailor-made safety cover made up of first tarpaulin elements which are joined together reversibly by transverse supports. A second modular covering tarpaulin is superimposed with the first tarpaulin and made up of second tarpaulin elements which are joined together reversibly by the same transverse supports. This second covering tarpaulin affords additional functions that can be modified according to the season. The two end transverse supports are coupled to lashing and tensioning mechanism for securing and holding down on ground covering device that is arranged over a pool.

31 Claims, 5 Drawing Sheets

MODULAR AND MULTIPURPOSE COVERING DEVICE FOR A POOL SUCH AS A SWIMMING POOL OR THE LIKE

TECHNICAL SCOPE

The invention relates to a modular and multipurpose covering device for a pool, in particular a swimming pool or the like, comprising a first modular covering tarpaulin made of first tarpaulin elements arranged adjacently, aligned in a first plane and joined together by transverse supports in order to obtain a covering device with the desired length, said first tarpaulin elements comprising on their transverse edges joining elements arranged to cooperate with first joining zones having a complementary shape provided in said transverse supports and allowing to realize a reversible assembly of the first tarpaulin elements together.

PRIOR ART

Publication EP 0 570 311 A1 discloses a cover intended for covering a pool, designed in a modular way and allowing a simple, quick and cost-effective custom manufacture with regard to the covers manufactured traditionally in one single piece. However, the modular cover described is limited to one single tarpaulin type and can therefore only fulfill one single function, for example that of preventing algae proliferation during the winter period. Consequently, to have a cover suitable for the different seasons, it is necessary to replace the tarpaulin elements of one type with tarpaulin elements of another type to confer another function to the modular cover, for example that of promoting the greenhouse effect in the summer period. Furthermore, if one or several tarpaulin elements are removed from the modular cover, covering a pool is no longer possible. In fact, only the tarpaulin elements allow joining the transverse supports together. Moreover, this modular cover shows no lashing means and no tensioning means that would allow tensioning and fastening the cover around the pool it covers, in order to prevent any accidental fall of a person and in particular of a child. Likewise, if a tarpaulin element was to be removed from the cover while it is arranged over a pool, the pool would no longer be protected against an accidental fall. Consequently, this modular cover is not a safety cover and does not comply with the safety standards in force.

Publication EP 2 623 691 B1 of the applicant discloses a safety cover provided with a protective net held in a technical frame, which is equipped with cover tensioning and lashing means allowing tensioning and securing the cover around the pool it covers. This safety cover moreover comprises an additional tarpaulin that can be superimposed on the safety net by means of reversible joining means, to provide an additional function that can easily be adapted and interchanged according to the season. However, the technical frame and the safety net are made in one single piece and must entirely be tailor-made, which entails longer delivery times and higher costs that the previous solution.

A pool cover is also known from publication EP 1 564 347 B1, formed of a covering tarpaulin in one single piece, integral with a series of parallel and transverse stiffening bars, fastened and tensioned around the pool by means of two tensioning cables extending longitudinally and slidingly engaged in sleeves provided respectively in the stiffening bars and in the longitudinal edges of the tarpaulin. This construction method is complex, expensive and tedious to implement. Moreover, it allows no modularity that would allow manufacturing a tailor-made and multifunctional cover.

Finally, publication EP 2 374 964 A1 describes a stiffening bar for manufacturing a tailor-made cover in one single piece. The tarpaulin elements are fastened on either side of a rail having a reversed T shape, which is then fit and self-locked in a longitudinal central groove arranged in the lower section of the stiffening bar. The tarpaulin elements are consequently fastened on the stiffening bar by a non-reversible, or at least hardly reversible, assembly. The stiffening bar moreover comprises two lateral longitudinal grooves to receive by sliding fasteners for cover tensioning straps. This construction method is not sufficiently modular to allow manufacturing a multifunctional cover.

Therefore the existing solutions are not satisfactory.

DESCRIPTION OF THE INVENTION

The present invention aims to overcome these disadvantages by offering a tailor-made, modular and multipurpose covering device that can be manufactured industrially in a simple, quick and cost-effective way, this device being easily adaptable to make it versatile and suitable for every season, while ensuring the safety of persons in compliance with the standards in force.

To this purpose, the invention comprises a covering device of the kind described in the preamble, characterized in that it moreover comprises a second modular covering tarpaulin, superimposed on first modular covering tarpaulin, and made of second tarpaulin elements with a width identical or slightly smaller than that of first tarpaulin elements, arranged adjacently, aligned in a second plane substantially parallel to the first plane in which said first modular covering tarpaulin is extending, and assembled to first tarpaulin elements by fastening means, said second tarpaulin elements comprising on their transverse edges joining elements arranged to cooperate with second joining zones having a complementary shape provided on said fastening means and allowing to realize a reversible assembly of second tarpaulin elements with respect to first tarpaulin elements, and in that second covering tarpaulin has technical properties different from those of first covering tarpaulin.

Optionally, the covering device can moreover comprise a third modular covering tarpaulin, superimposed on first and second modular covering tarpaulins, and made of third tarpaulin elements with a width identical or slightly smaller than that of first and/or second tarpaulin elements, arranged adjacently, aligned in a third plane substantially parallel to the first and second planes in which said first and second modular covering tarpaulin are respectively extending, and assembled to first and/or second tarpaulin elements by fastening means, said third tarpaulin elements comprising on their transverse edges joining elements arranged to cooperate with third joining zones having a complementary shape provided on said fastening means and allowing to realize a reversible assembly of the third tarpaulin elements with respect to first and second tarpaulin elements, and in that third covering tarpaulin has technical properties different from those of first and second covering tarpaulins.

In a first embodiment variant of the invention, the fastening means of second and/or third tarpaulin elements are merged with said transverse supports and form one single part.

In a second embodiment variant of the invention, the fastening means of second and/or third tarpaulin elements are distinct from said transverse supports and form separate parts.

In all cases, the transverse supports of the covering device are advantageously made each of a supporting bar having a cross-section symmetrical at least with respect to a median plane perpendicular to said first plane, said supporting bar comprising said first joining zones, arranged symmetrically with respect to said median plane and aligned in said first plane.

In the first embodiment of the invention, the supporting bar moreover comprises said second joining zones, arranged symmetrically with respect to said median plane and aligned in said second plane. It can also comprise said third joining zones, arranged symmetrically with respect to said median plane and aligned in said third plane.

In the second embodiment of the invention, the fastening means of said second tarpaulin elements comprise fastening profiles integral with said first tarpaulin elements, extending on all or on a part of their length, parallel to each of their transverse edges and comprising said second joining zones arranged in said second plane. Said fastening profiles can moreover comprise said third joining zones arranged in said third plane.

The fastening means can also comprise additional fastening profiles, integral with said second tarpaulin elements, extending on all or on a part of their length, parallel to each of their transverse edges, said additional fastening profiles comprising said third joining zones arranged in said third plane.

Optionally, said supporting bars can moreover comprise an additional joining zone arranged in said median plane and in the lower section of said supporting bars. In this case, the covering device advantageously comprises anti-wear pads arranged underneath said supporting bars and extending on all or on a part of their length, said pads comprising at least one joining element arranged to cooperate with said additional joining zone provided in said supporting bars, allowing to achieve a reversible assembly of said pads.

Said joining zones provided in the supporting bars and/or in the fastening profiles can advantageously be formed by longitudinal grooves extending parallel to the longitudinal axis of said supporting bars and/or of said fastening profiles, and ending at their ends. In this case, the joining elements provided on the tarpaulin elements and/or on the pads can advantageously comprise rods or bolt ropes having a shape complementary to said longitudinal grooves.

The covering device of the invention can advantageously comprise guiding end pieces made of materials with a low friction coefficient and arranged to fit at the ends of said supporting bars to facilitate and guide the insertion of said joining elements of the tarpaulin elements in said joining zones of the supporting bars Preferably, the first covering tarpaulin is a safety cover, and two of the transverse supports form end transverse supports assembled to the opposite ends of said first covering tarpaulin and coupled on one side with lashing means and on the other side with tensioning means arranged to secure said covering device to the ground when it is placed above a pool. Said end transverse supports can be different from the other transverse supports.

In a preferred embodiment of the invention, the first covering tarpaulin advantageously comprises receiving means extending along its longitudinal edges to receive tensioning elements associated respectively with said lashing and tensioning means of the covering device when it is arranged above a pool, allowing holding said covering device down on the ground.

To this purpose, the first tarpaulin elements can comprise on their longitudinal edges a slide that forms said receiving means of the first covering tarpaulin, and said tensioning elements coupled with the lashing and tensioning means can be straps or rods passing in the successive slides of the first tarpaulin elements up to the two end transverse supports.

The first covering tarpaulin can moreover comprise at least one first tarpaulin end element arranged between one of the transverse supports and one of the end transverse supports, which can have a width different from that of the first tarpaulin elements and/or which can have technical properties different from those of the first tarpaulin elements. One of said first tarpaulin end elements can also have a width such that it allows covering by rolling up the whole of said covering device when it is rolled on itself in storage position.

The second covering tarpaulin and/or said third covering tarpaulin are preferably arranged to add a greenhouse effect and/or a light filter effect to the safety function of said first covering tarpaulin.

Said tarpaulin elements can moreover comprise at their four corners a buckle or an eyelet to receive a pulling strap that will facilitate the installation and removal of said tarpaulin elements with respect to said supporting bars.

For the purpose stated above, the invention also relates to a modular and interchangeable tarpaulin element for the modular and multipurpose covering device defined above, comprising on its parallel transverse edges joining elements intended for cooperating with complementary joining zones provided in transverse supports and/or fastening means of said covering device when they are joined to form a covering tarpaulin.

It can form at choice a tarpaulin element having a safety function, made of a net whose meshes show a free area/mesh size ratio larger than 50%, a tarpaulin element having a greenhouse effect function, made of a flexible, transparent or translucent material, reinforced or not, with a solar factor g comprised between 60% and 100%, or a tarpaulin element having a light filter function, made of a flexible, opaque or semi-opaque material, reinforced or not, said material can be chosen to stop the wavelengths between 400 and 700 nm and/or the wavelengths between 280 and 310 nm.

It can moreover comprise two fastening profiles extending on all or on a part of its length, parallel to each of its transverse edges, said fastening profiles comprising at least one joining zone extending in a plane parallel to said tarpaulin element, facing each other, intended for receiving the joining element of another tarpaulin element when they are assembled together in order to be superimposed.

Optionally, said fastening profiles can comprise two superimposed joining zones extending in two planes parallel to said tarpaulin element, facing each other, intended for receiving the joining element of two other tarpaulin elements when they are assembled together in order to be superimposed.

The invention finally relates to a transverse support for the modular and multipurpose covering device described above, made of a supporting bar with a cross-section symmetrical at least with respect to a median plane perpendicular to a first plane, comprising first joining zones, arranged symmetrically with respect to said median plane and aligned in said first plane, and second mounting zones, arranged symmetrically with respect to said median plane and aligned in a second plane parallel to said first plane.

Optionally, said supporting bar can comprise third joining zones, arranged symmetrically with respect to said median plane and aligned in a third plane parallel to said first plane. It can also comprise an additional joining zone arranged in said median plane and in the lower section of said supporting bar, intended for cooperating with a additional joining element provided on anti-wear pads.

BRIEF DESCRIPTION OF THE DRAWINGS

The present invention and its advantages will be better revealed in the following description of several embodiments given as non-limiting examples, in reference to the drawings in appendix, in which.

ILLUSTRATIONS OF THE INVENTION AND VARIOUS WAYS OF REALIZING IT

Referring to the figures, modular and multipurpose covering device 10 according to the invention is arranged to cover a pool 1 by extending above and substantially parallel to the surface of said pool 1. Pool 1 concerned by the invention can be, as a non-limiting example, a swimming pool or any other basin type requiring a cover to obturate and/or secure its access. This pool 1 can moreover have any possible contour shape, geometrical or not, parallelogram-shaped or not and, as a non-limiting example, a bean shape visible by transparency in FIG. 1. Covering device 10 generally has a parallelogram shape that delimits a covering surface that is preferably larger than the surface of the pool to ensure fully its covering function of pool 1 and its safety function against accidental falls in pool 1.

Figure 1:
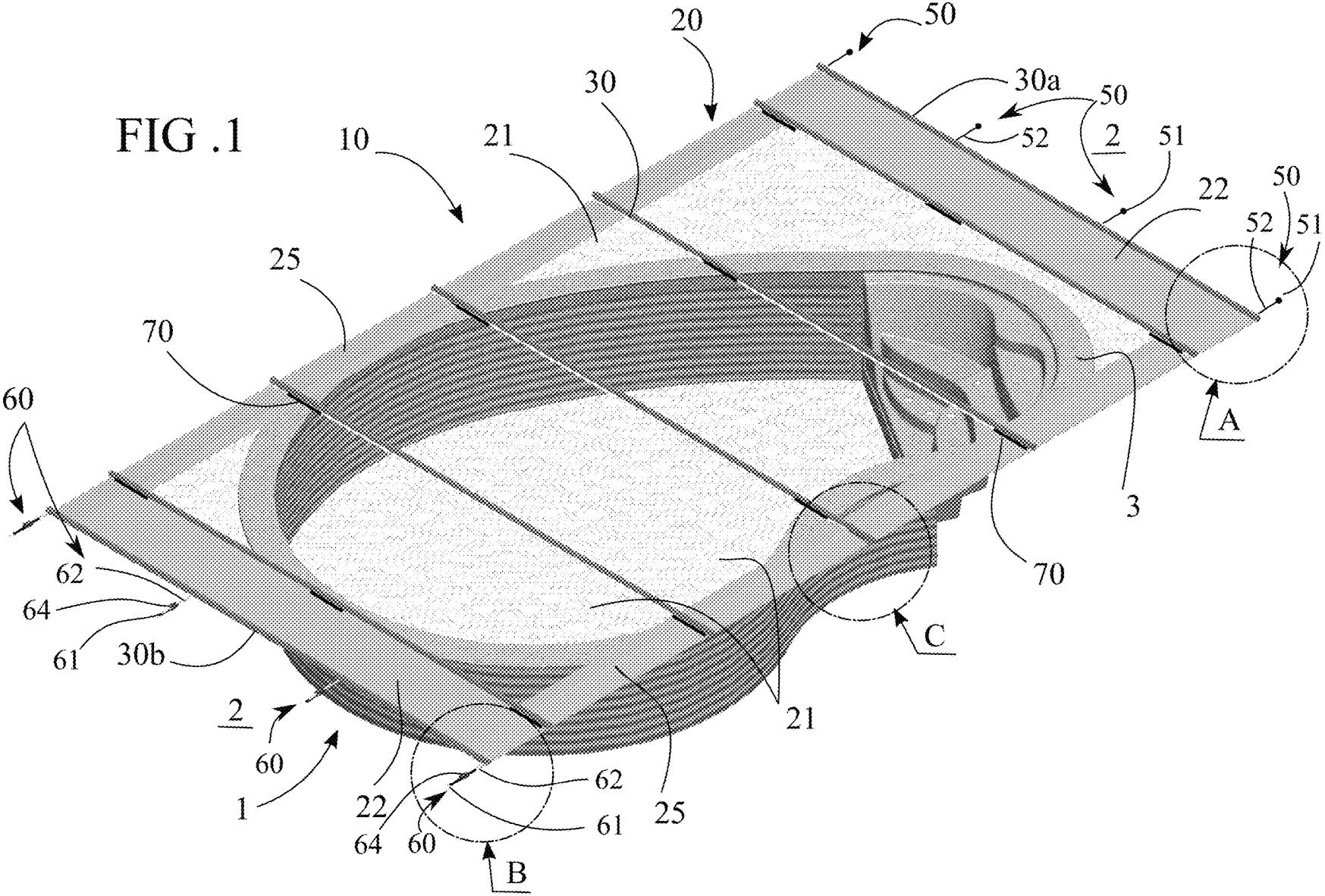
FIG. 1 represents a perspective view of a modular and multipurpose covering device according to the invention placed on a pool, showing the first modular covering tarpaulin, the transverses supports and the lashing and tensioning means.

Referring more specifically to FIG. 1, covering device 10 comprises a first modular covering tarpaulin 20, made of first tarpaulin elements 21, arranged adjacently, aligned in a first plane P1 and joined together by transverse supports 30. These transverse supports 30 are parallel to each other and arranged to rest on the periphery of pool 1, two of these transverse supports 30*a*, 30*b* being placed at the ends of said first modular covering tarpaulin 20. This modular construction method allows manufacturing a covering device 10 of the required length by joining a suitable number of first tarpaulin elements 21 and of transverse supports 30. These first tarpaulin elements 21 are made of rectangular panels, of identical dimensions, whose width defines a standard width. Transverse supports 30 are consequently placed at a regular interval, which corresponds to the standard width of these first tarpaulin elements 21. In the represented example, covering device 10 moreover comprises two first tarpaulin end elements 22, which may have a width different from that of first tarpaulin elements 21, in particular to allow adjusting the length of covering device 10 to the length of pool 1, if this length is not a multiple of the standard width. In this case, the interval between the two end transverse supports 30*a*, 30*b* and the other transverse supports 30 is different. Of course, one single first tarpaulin end element 22 with a different width could also be suitable. Tarpaulin end element 22 located on the side intended for storing covering device 10 (that is to say the side of lashing means 50 and of transverse support 30*a*) can have a width sufficient to cover by rolling up the whole of covering device 10 and therefore protect the latter against solar radiation when it is stored rolled up at the right end of pool 1 on FIG. 1.

The plurality of transverse supports 30, 30*a*, 30*b* forms a frame that allows supporting and stiffening covering device 10. From this results increased safety. This configuration also allows increasing the tension of covering device 10. It is thus possible to prevent it from being in contact with the water of pool 1 when it is placed above a pool 1. Covering device 10 fully forms a safety cover that complies with the safety standards in force, that is to say that permanently guarantees the safety of pool 1 by preventing any accidental fall in the water. To this purpose, it comprises lashing means 50 and tensioning means 60 that cooperate on one hand with the two end transverse supports 30*a*, 30*b* and on the other hand with eyebolts (not represented) anchored in the ground or in platform 2 and facing said ends to secure to the ground or on platform 2 that surrounds pool 1 covering device 10 tensioned and held down on the ground, as described below. Lashing means 50 are coupled to one of the end transverse supports 30*a* on the side generally intended for storing covering device 10, and tensioning means 60 are coupled to the other end transverse support 30*b* on the side generally intended for rolling up covering device 10.

First tarpaulin elements 21 making up first covering tarpaulin 20 are made from a strip of reinforced or not reinforced net, a reinforced or not reinforced openwork or non-openwork fabric, a flexible material such as an extruded film, a calendered fabric, a non-woven material, transparent or translucent and reinforced or not reinforced, or the like. According to an embodiment variant, first tarpaulin elements 21 are made of a net, for example out of polyester, whose mesh shows a free area/mesh size ratio larger than 50%. The net can be coated for example with polyvinyl chloride or any other thermoplastic material suitable for allowing assembly by welding. The construction of the mesh of the net must preferably be made so that the warp of the net cannot slide on the weft of the net if an obstacle was to get caught in a mesh of the net. One therefore will prefer a net whose warp/weft junctions are fixed, for example by means of a knot, a welding point, fastening means or by knitting or weaving the meshes, before coating with polyvinyl chloride. First tarpaulin end elements 22 can be made in another material than that of the other first tarpaulin elements 21, such as a polyvinyl chloride, reinforced or not, to provide additional functions such as a good mechanical strength, long lifetime, with a more or less high solar reflection index. Of course, these examples are not limiting.

First tarpaulin elements 21, 22 comprise on their transverse edges joining elements 23 arranged to cooperate with first joining zones 34 having a complementary shape provided in transverse supports 30 and allowing to realize a reversible assembly of first tarpaulin elements 21, 22 with each other. This reversible assembly facilitates their joining and allows their removal in case of repair or replacement of one or several first tarpaulin elements 21, 22. Joining elements 23 are fastened along the transverse edges of every first tarpaulin element 21, 22 by any suitable method such as welding, gluing, sewing, etc.

Figure 2:
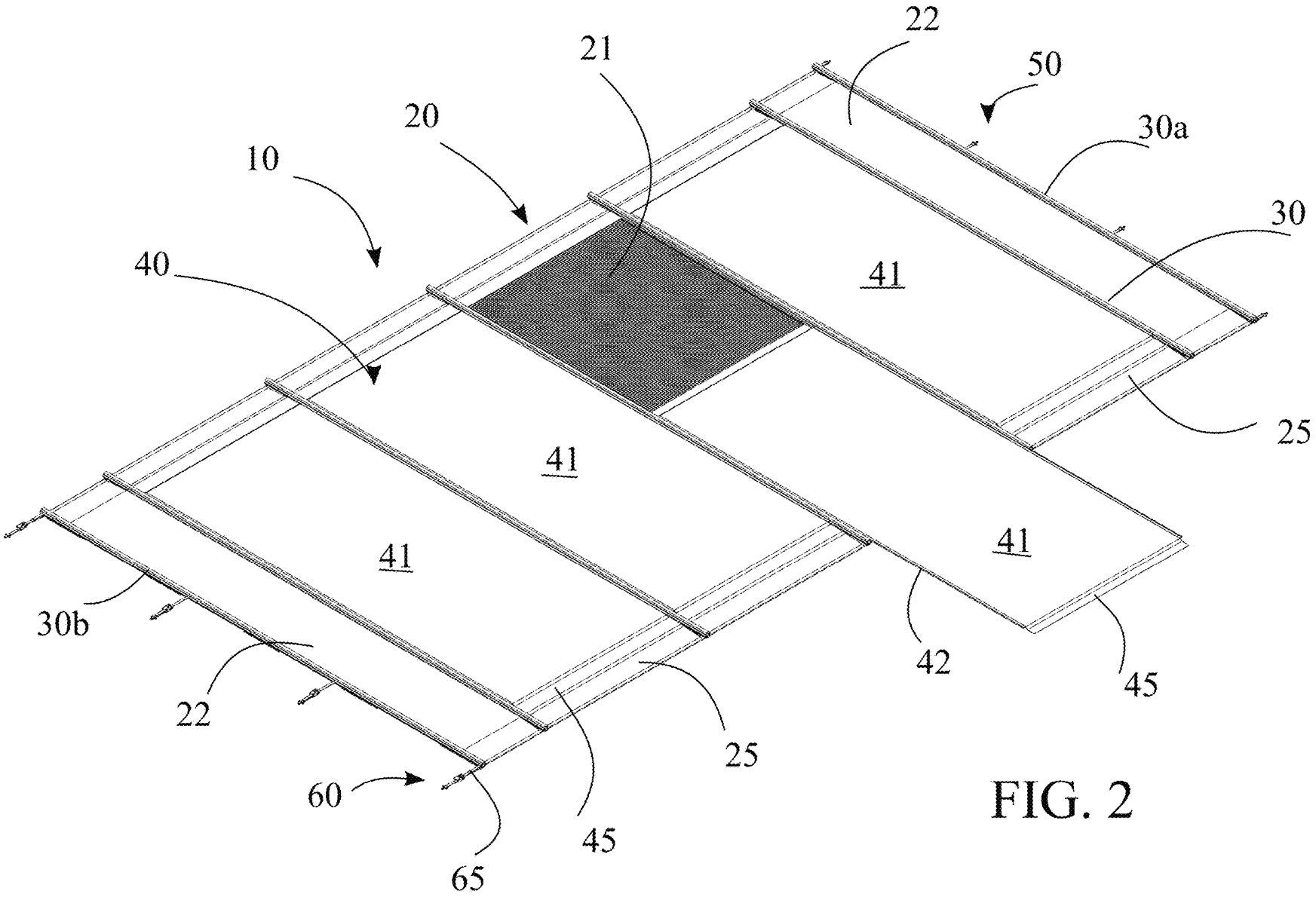
FIG. 2 is a perspective of the covering device of FIG. 1 showing the second covering tarpaulin superimposed on the first covering tarpaulin, with one of the second tarpaulin elements partly removed.

Referring more specifically to FIG. 2, covering device 10 comprises a second modular covering tarpaulin 40 that is superimposed on and substantially parallel to first modular covering tarpaulin 20. It does not necessarily have the same length and may not cover the first tarpaulin end elements 22 of first modular covering tarpaulin 20, for example. This second covering tarpaulin 40 has technical properties different from those of first covering tarpaulin 20, allowing adding an additional function to the protection and safety function of first covering tarpaulin 20. It allows in particular adapting the technical performance of covering device 10 to the seasons by adding either a greenhouse effect or a light filtering effect.

This second covering tarpaulin 40 is made of second tarpaulin elements 41 arranged adjacently, aligned in a second plane P2 substantially parallel to first plane P1, and joined to first tarpaulin elements 21 by fastening means 80. These second tarpaulin elements 41 are made of rectangular panels, of a width identical or slightly smaller than the width of first tarpaulin elements 21, depending on their joining method. Second tarpaulin elements 41 comprise on their transverse edges joining elements 42 arranged to cooperate with second joining zones 82 having a complementary shape provided in fastening means 80 and allowing to realize a reversible assembly of second tarpaulin elements 41 with respect to first tarpaulin elements 21. This reversible assembly facilitates their joining and allows their removal in case of repair or replacement of second tarpaulin elements 41 of one type with second tarpaulin elements 41 of another type, allowing modulating the structure of second covering tarpaulin 40 according to the needs and/or the seasons. Joining elements 42 are fastened along the transverse edges of every second tarpaulin element 41 by any suitable method such as welding, gluing, sewing, etc.

Second tarpaulin elements 41 are preferably made out of a flexible material whose nature is chosen according to the needs and/or the seasons. For summer use, the material of second tarpaulin elements 41 will be chosen among a flexible material, transparent or translucent, reinforced or not. For example, they can have a solar factor g comprised between 60% and 100%. The weight of a second tarpaulin element 41 is preferably comprised between 50 and 300 $g/m^2$. They can be made out of a polymer, such as polyvinyl chloride, polyurethane, polyethylene, polyethylene-vinyl acetate or the like. They can also be made out of a fluoropolymer such as polyethylene-co-tetrafluoroethylene, polyvinylidene fluoride or the like. Such second tarpaulin elements 41 allow letting the sun rays pass to contribute heating the water contained in pool 1 by greenhouse effect. They can also filter certain wavelengths. As an example, one can choose a material intended for stopping the 280 and 310 nm wavelengths, which are responsible for chlorine destruction and/or the 400 to 700 nm wavelengths, which are responsible for algae development (through the choice of the material, treatment, coating and/or additives such as pigments). For winter use, the material of second tarpaulin elements 41 will be chosen among a flexible material, opaque or semi-opaque, reinforced or not. They can be made out of polyvinyl chloride, reinforced or not, polyethylene, polypropylene or the like. Such a choice allows stopping the sun rays and preventing algae proliferation. As an example, one can choose a material intended for stopping the 400 to 700 nm wavelengths, which are responsible for algae development. Of course, the mentioned examples are not limiting.

The modular construction of first and second covering tarpaulins 20, 40 allows widening the possible material combinations and joining tarpaulin elements 21, 41 of the same nature or of different natures together.

Transverse supports 30, 30*a*, 30*b* comprise each a supporting bar 31, 32, 33 of a length at least equal to the length of first tarpaulin elements 21, 22, and preferably equal to this length, to prevent them from protruding from the longitudinal edges of covering device 10. Supporting bars 31, 32, 33 are preferably identical for a same covering device 10, but they could also be different. In particular, the supporting bars intended to form end transverse supports 30*a*, 30*b* can be different in their dimension and/or their cross-section. They advantageously have a cross-section symmetrical with respect to a first median plane P perpendicular to planes P1 and P2 in which respectively first and second covering tarpaulins 20, 40 are extending above a pool 1. Thus, supporting bars 31, 32, 33 are reversible and can be used independently in one direction and in the other. Moreover, their symmetrical cross-section favors the even distribution of the traction efforts undergone when tensioning covering device 10. They could however have a non-symmetrical cross-section without departing from the invention. In the examples illustrated in FIGS. 4 and 5, supporting bars 31, 32 have a hexagonal cross-section, also symmetrical with respect to a second median plane M perpendicular to first median plane P, this cross-section further improves the bending resistance of supporting bars 31, 32 thanks to the edges between two adjacent sides. In the example illustrated in FIG. 6, supporting bar 33 has a substantially trapezoidal cross-section whose large side is curved, also providing good bending resistance. Of course, any other cross-section compatible with the technical constraints imposed on supporting bars 31, 32, 33 could be suitable, such as a circular, semi-circular, square, ovoid, triangular, etc., cross-section. Supporting bars 31, 32, 33 are ideally hollow to make them lighter, but they could also be solid. They are preferably made of extruded and anodized aluminum profiles, but they can also be made of pultruded composite material profiles, or of any other compatible material. When they are hollow, their open ends are preferably closed by a not represented plug to avoid the penetration of water and dirt inside of said supporting bars.

Figure 4:
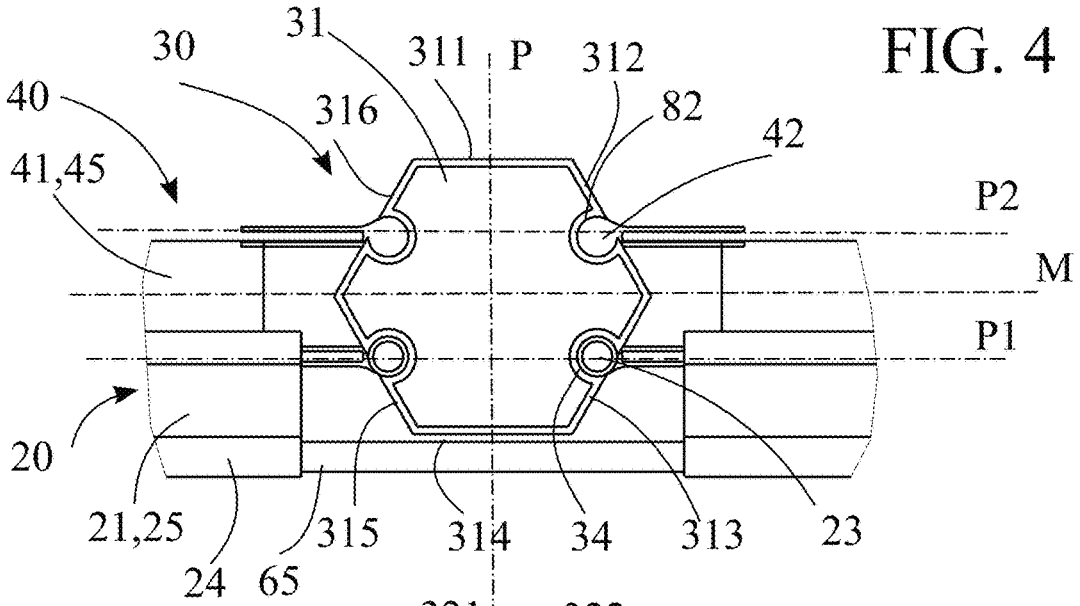
FIG. 4 is a side view of a transverse support of the covering device of FIG. 1, according to a first embodiment.
Figure 5:
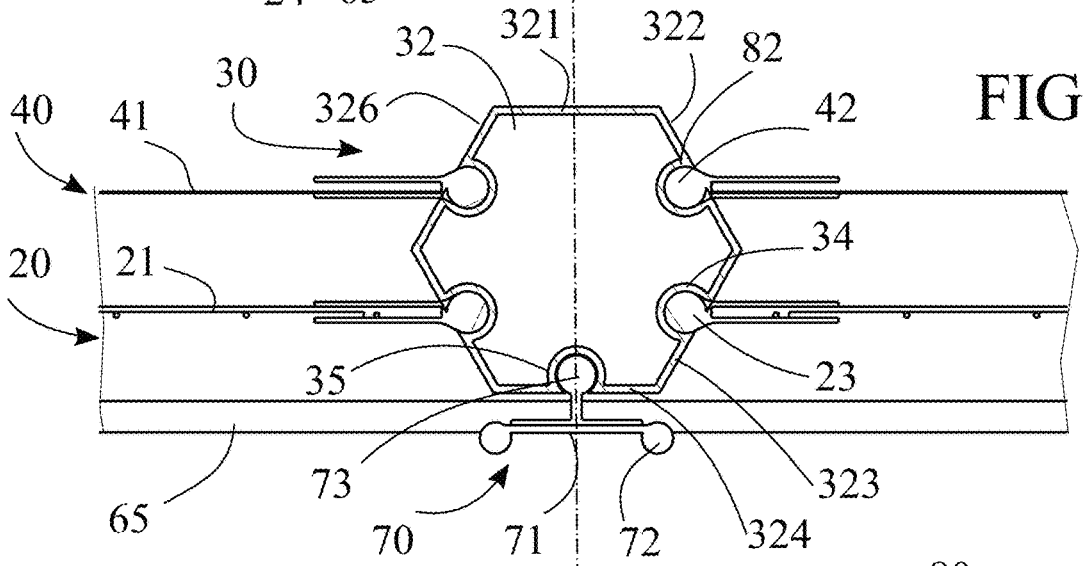
FIG. 5 is a view similar to that of FIG. 4 of a transverse support, according to a second embodiment variant.

In the embodiment examples illustrated in FIGS. 4 and 5, fastening means 80 of second tarpaulin elements 41 are merged with transverse supports 30 and form one single part, that is to say supporting bars 31, 32, which allow the reversible joining both of the first and of the second tarpaulin elements 21, 41. In this embodiment variant, supporting bars 31, 32 comprise six longitudinal faces 311, 312, 313, 314, 315, 316; 321, 322, 323, 324, 325, 326, and are oriented in covering device 10 so that two of the opposite longitudinal faces 311, 314; 321, 324 are arranged in planes parallel to planes P1 and P2. The other longitudinal faces opposite two by two 312, 313, 315, 316 322, 323, 324, 325 comprise first and second joining zones 34, 82. Supporting bars 31, 32 comprise two first joining zones 34, arranged symmetrically with respect to median plane P and aligned in first plane P1 to receive first tarpaulin elements 21. They moreover comprise two second joining zones 82, arranged symmetrically with respect to median plane P and aligned in second plane P2 to receive second tarpaulin elements 41. The two planes P1 and P2 are moreover arranged symmetrically with respect to second median plane M of supporting bars 31, 32 allowing balancing the traction efforts.

Figure 6:
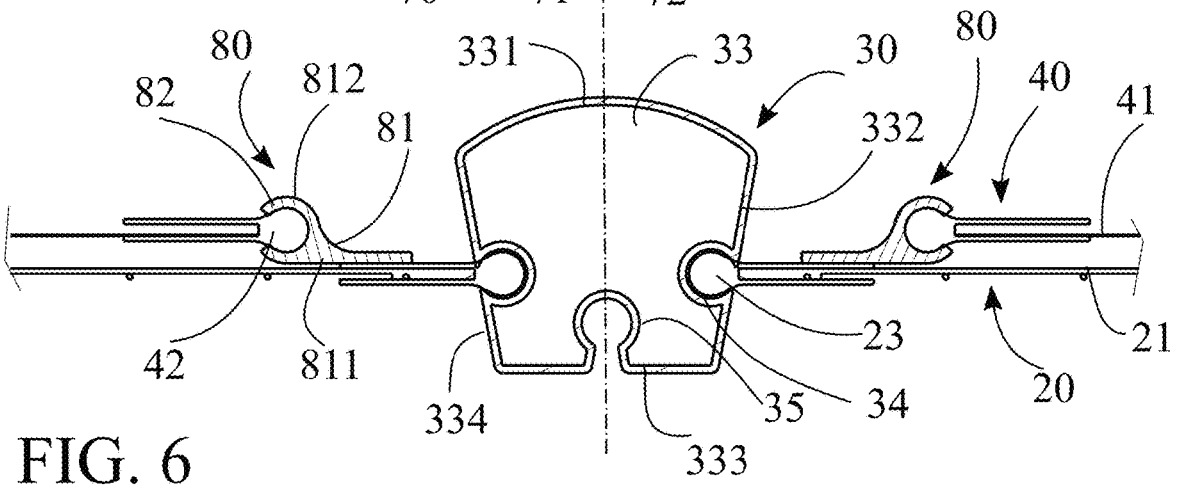
FIG. 6 is a view similar to that of FIG. 4 of a transverse support, according to a third embodiment variant.

In the embodiment example illustrated in FIG. 6, fastening means 80 of second tarpaulin elements 41 are distinct from transverse supports 30 and form with the latter two separate parts, that is to say supporting bars 33 allowing the reversible joining of first tarpaulin elements 21, and fastening profiles 81 attached two by two on first tarpaulin elements 21 allowing the reversible joining of second tarpaulin elements 41. In this embodiment variant, supporting bars 33 comprise four longitudinal faces 331, 332, 333, 334, among which a lower face 333 parallel to planes P1 and P2 and a curved upper face 331. The two other opposite longitudinal faces 332, 334 comprise first joining zones 34 to receive first tarpaulin elements 21, 22 in first plane P1. Still in this embodiment variant, fastening profiles 81 comprise a longitudinal wing 811 surmounted with a bead 812 comprising one of second joining zones 82. Fastening profiles 81 extend on all or on a part of the length of first tarpaulin elements 21, parallel to their transverse edges, facing each other to receive between them a second tarpaulin element 41, with a width slightly smaller than the width of first tarpaulin elements 21. Fastening profiles 81 are arranged to be firmly fixed on first tarpaulin elements 21 by any suitable method such as welding, gluing, sewing, etc.

In the illustrated examples, first and second joining zones 34, 82 provided in supporting bars 31, 32, 33 and fastening profiles 81 are formed by longitudinal grooves, for example with a circular cross-section, which extend on the whole length of supporting bars 31, 32, 33 and of fastening profiles 81, and end at their ends. Joining elements 23, 42 provided on the transverse edges respectively of first tarpaulin elements 21, 22 and of second tarpaulin elements 41 are made of rods, of bolt ropes, or the like, for example with a circular cross-section complementary to the longitudinal grooves, which extend over all or a part of the length of said tarpaulin elements 21, 22, 41. They preferably end before the end of tarpaulin elements 21, 22, 41 to allow these ends to rest naturally on the ground or on platform 2 surrounding pool 1. Of course, any other shape may be suitable for the joining zones and the complementary joining elements. These joining zones 34, 82 and these complementary joining elements 23, 42 allow a sliding connection between tarpaulin elements 21, 22, 41 and supporting bars 31, 32, 33 or fastening profiles 81 in the respective plane P1, P2 of covering tarpaulins 20, 40. This arrangement allows moving tarpaulin elements 21, 22, 41 by means of a simple translation movement in the corresponding plane P1, P2. From this results that tarpaulin elements 21, 22, 41 can be detached from each other. When covering device 10 is placed above a pool 1 and is lashed to the ground, it is thus possible to remove one or several second tarpaulin elements 41 from the edge of pool 1 by pulling the corresponding longitudinal edge, as shown in FIG. 2, to replace it or to uncover partly pool 1 to avoid overheating the water it contains, while ensuring the safety against falls provided by first tarpaulin element(s) 21, which are uncovered, but remain in place above pool 1. This configuration makes the handling of second tarpaulin elements 41 very easy, without having to walk on covering device 10, unlike a zipper system, which might be suitable technically and fulfill the same reversible joining function. With this configuration, it is also possible to remove easily one or several tarpaulin elements 21, 22, 41 to replace them without having to remove or dismount covering device 10 from pool 1. To help removing and/or putting in place tarpaulin elements 21, 22, 41, a buckle, an eyelet or the like can be fastened at the four corners of every tarpaulin element, allowing fastening or passing a pulling strap One consequently uses two pulling straps fastened at the two corners of a same longitudinal edge of tarpaulin element 21, 22, 41 to pull it and have it slide in joining zones 34, 82 in the direction opposite to pool 1 to remove it and towards pool 1 to put it in place.

In the embodiment represented in FIG. 5, supporting bar 32 moreover comprises an additional joining zone 35 centered on first median plane P and provided on bottom longitudinal face 324 of supporting bar 32, facing pool 1. In this embodiment, covering device 10 is completed with anti-wear pads 70 arranged under supporting bars 32 and extending on all or a part of their length. They comprise a plate 71 that is flat or provided with beads 72 and, in their upper section, a joining element 73 arranged to cooperate with additional joining zone 35 provided in supporting bars 32 allowing a reversible assembly of pads 70 and adjusting their position. FIG. 1 illustrates an example of the positioning of several pads 70 under covering device 10 above coping 3 surrounding pool 1 and the ground or platform 2 bordering pool 1 in order to facilitate unrolling and rolling up covering device 10 by eliminating the friction efforts and to avoid damages, markings and premature wear at the same time on supporting bars 32, coping 3 and platform 2 bordering pool 1. Supporting bar 33 of FIG. 6 also comprises an additional joining zone 35 that can receive one or several pads 70. This embodiment variant allows sliding pads 70 freely along supporting bars 32, 33 to be able to position them simply above the coping according to the shape of pool 1, especially if pool 1 has a free shape.

On the other hand, for supporting bar 31 of FIG. 4, which is not provided with additional joining zone 35 and thus cannot receive pads 70, it is possible to add at least on lower longitudinal face 314 an anti-wear element (not represented) that can fulfill the same sliding functions as pads 70. This anti-wear element could be in the form of a coating intimately bonded on supporting bar 31, or of a profile attached on supporting bar 31. It can be made of a flexible material such as polyvinyl chloride, and it can extend on all or a part of the length of supporting bar 31.

In covering device 10 according to the invention, first covering tarpaulin 20 comprises receiving means 24 that extend along its longitudinal edges to receive tensioning elements 65 associated with the tensioning means 60 of covering device 10. More specifically and referring to FIG. 3C, all first tarpaulin elements 21 comprise two end flaps 25 that define their longitudinal edges. These end flaps 25 comprise the receiving means 24 formed by a slide or the like, arranged to be crossed by a tensioning element 65 formed by a tensioning rod, a strap or the like. Each tensioning element 65 is led through the successive slides of first tarpaulin elements 21 up to supporting bars 31, 32, 33 of the two end transverse supports 30*a*, 30*b*. Each tensioning element 65 ends at its both ends with a buckle 66 arranged to cooperate with end lashing means 50 on one side and end tensioning means 60 on the other side of covering device 10 allowing to exert on covering device 10 a longitudinal tension having the effect of holding its longitudinal edges down on ground 2 on either side of pool 1, thus preventing any attempt to access pool 1 passing under covering device 10.

Figure 3A:
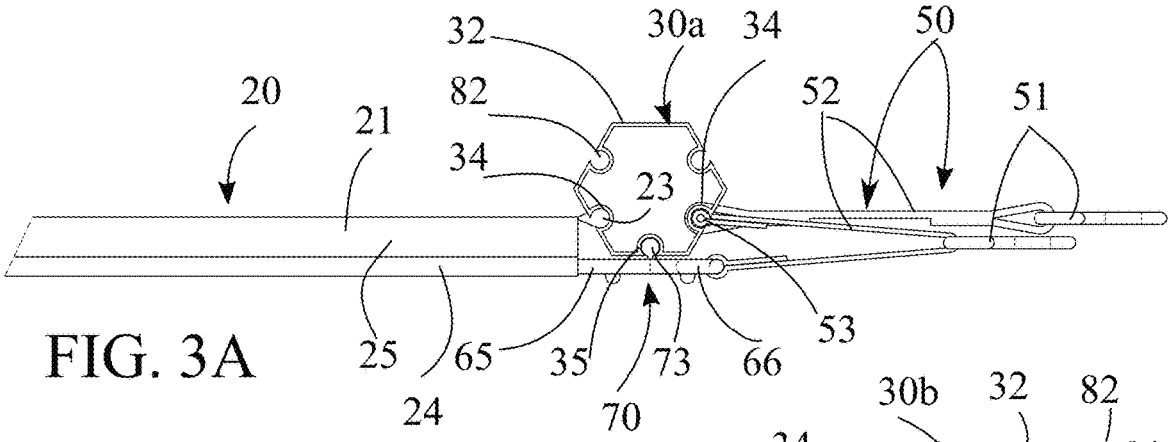
FIGS. 3A, 3B and 3C are enlarged views respectively of details A and B in a side view, and of detail C of the covering device of FIG. 1.

Lashing means 50 of FIG. 1, represented more in detail in FIG. 3A with supporting bar 32 of FIG. 5, comprise in a known way several buckles 51 carried each by a strap 52 reversibly joined to supporting bar 32 of one of end transverse supports 30*a* delimiting one of the ends of covering device 10 to form a number N of lashing points, N being determined according to the length of the cover to be lashed. To this purpose, each strap 52 comprises a joining element 53 inserted in free first joining zone 34 of supporting bar 32. Several straps 52 can thus be mounted and positioned easily in end transverse support 30*a* to be distributed on its whole length (see FIG. 1). Each buckle 51 is preferably metallic and arranged to cooperate with an eyebolt (not represented) anchored in the ground or in platform 2 surrounding pool 1. For end lashing means 50 provided in the extension of the two longitudinal edges of covering device 10, strap 52 is assembled at one of its ends with corresponding tensioning element 65 through its buckle 66 to create a fixed lashing point of said tensioning element 65 by means of buckle 51. FIG. 3A illustrates both, in a superimposed way, end lashing means 50 forming a reconnecting loop with tensioning element 65, and central lashing means 50 without reconnecting loop.

Figure 3B:
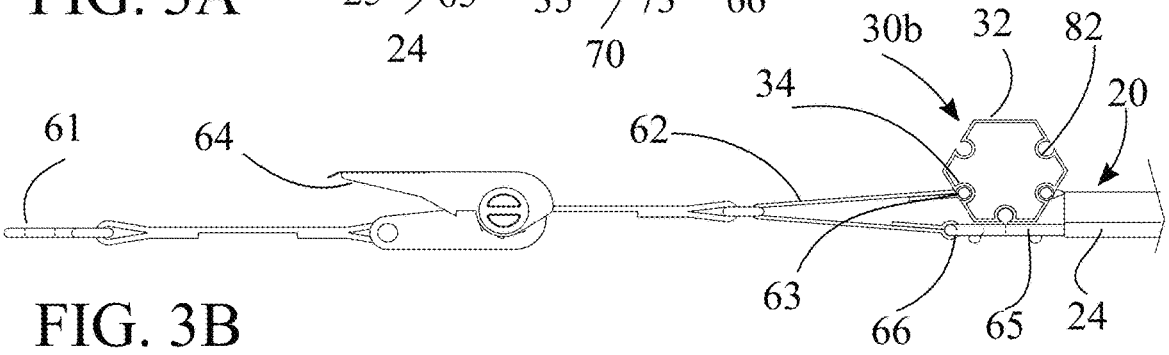
Figure 3C:
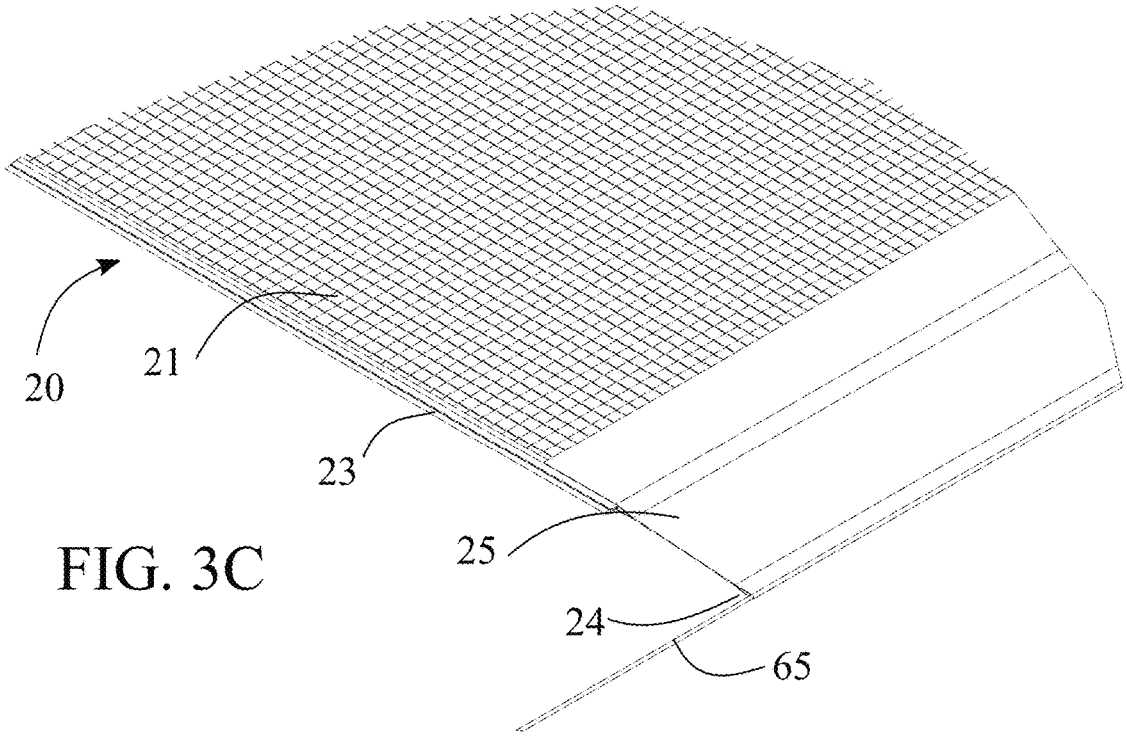

Tensioning means 60 of FIG. 1, represented more in detail in FIG. 3B with supporting bar 32 of FIG. 5, comprise in a known way several buckles 61 carried each by a strap 62 reversibly joined to supporting bar 32 forming the other end transverse support 30*b* delimiting the opposite end of covering device 10 to form a number N of tensioning points, N being determined according to the length of the cover to be tensioned. They moreover comprise several tensioning ratchets 64 mounted each between a buckle 61 and a strap 62 to allow adjusting the tension applied on covering device 10. Each strap 62 comprises a joining element 63 inserted in free first joining zone 34 of supporting bar 32. Several straps 52 can thus be mounted and positioned easily in end transverse support 30*a* to be distributed on its whole length (see FIG. 1). Each buckle 61 is preferably metallic and arranged to cooperate with an eyebolt 4 (not represented) anchored in the ground or in platform 2 surrounding pool 1. For end tensioning means 60 provided in the extension of the two longitudinal edges of covering device 10, each strap 62 is assembled at one of its ends with corresponding tensioning element 65 through its buckle 66 to tension said tensioning element 65 lashed at a fixed lashing point at the opposite end of covering device 10. FIG. 3B only illustrates one end tensioning means 60 forming a reconnecting loop with tensioning element 65.

End flaps 25 provided to form the longitudinal edges of first tarpaulin elements 21, 22 can be formed in one piece with the panels, or attached at the corresponding ends of the panels by any suitable method such as welding, gluing, sewing, etc. Second tarpaulin elements 41 can also comprise end flaps 45 (see FIG. 2) formed in one piece with the panels or attached at the corresponding ends of the panels. They are simple, that is to say formed of one single material layer, and they cover corresponding end flaps 25 of first tarpaulin elements 21. They can comprise reversible fastening means (not represented) such as buttons, hooks or others to be fastened on end flaps 25. End flaps 25, 45, as well as tarpaulin end elements 22 (see FIGS. 1 and 2) as a whole can be made out of a flexible material, reinforced or not, such as a polymer of the polyvinyl chloride, polyurethane, polyethylene, polyethylene-vinyl acetate type or the like. These end flaps 25, 45 are not indispensable, but they allow reinforcing the longitudinal edges of covering device 10 and they facilitate the handling of tarpaulin elements 21, 22, 41.

Figure 9A:
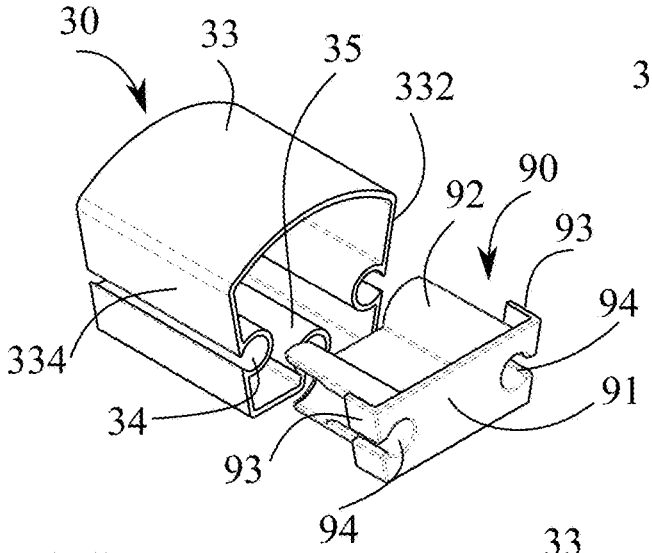
FIGS. 9A and 9B are respectively an exploded view and an assembled view of an end of a transverse support equipped with a mounting end piece.
Figure 9B:
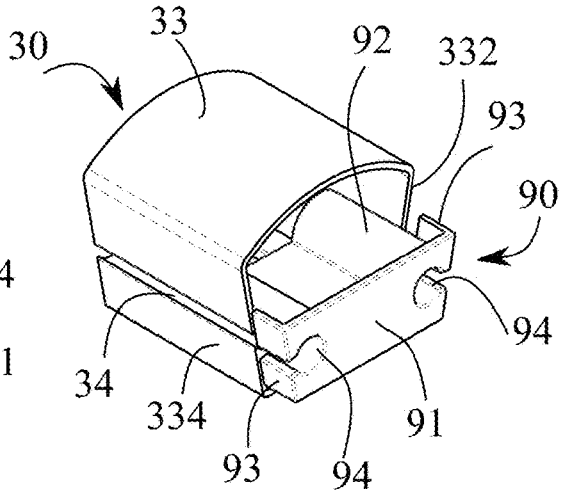
Figure 10:
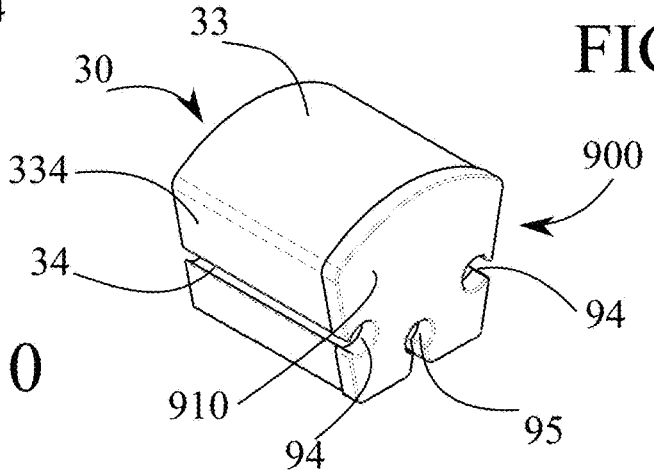
FIG. 10 is a view similar to FIG. 9B showing another embodiment variant of the mounting end piece acting also as a plug.

FIGS. 9A, 9B and 10 illustrate two examples of a guiding end piece 90, 900 arranged to help putting tarpaulin elements 21, 22, 41 in place. It is intended to be added at the corresponding ends of supporting bars 31, 32, 33 instead or as a replacement of the plugs closing said ends. Guiding end piece 90, 900 represented is associated to supporting bar 33 illustrated in FIG. 6, provided with two joining zones 34 and an additional joining zone 35, but it can of course be adapted to supporting bars 31, 32 of FIGS. 4 and 5 and to any other similar bar. Referring to FIGS. 9A and 9B, guiding end piece 90 is installed temporarily, during the handling operations of tarpaulin elements 21, 22, 41, and removed once the tarpaulin elements are in place. The geometry and material of this guiding end piece 90 allow guiding and favoring the sliding of joining elements 23, 42 when entering joining zones 34, 82 to avoid jamming tarpaulin elements 21, 22, 41 in supporting bars 31, 32, 33. To this purpose, guiding end piece 90 is formed of a preferably monobloc part, made of a synthetic material with a low friction coefficient, such as for example a polyoxymethylene (POM) or the like, or of another material that does not have this property, but is partly or totally treated or coated with a coating with a low friction coefficient. It comprises a front side 91 extended by a male rear section 92 configured to fit inside of the internal volume of supporting bar 33. Its front side 91 is extended laterally by two side faces 93 shorter than male rear section 92, to serve as fitting stop abutting against the edge of longitudinal sides 334 of supporting bar 33. It moreover comprises in its side faces 93 two entry zones 94, whose cross-section corresponds to that of first joining zones 34 of supporting bar 33, located before said joining zones 34 when guiding end piece 90 is mounted on said supporting bar 33 (FIG. 9B). Guiding end piece 900 illustrated in FIG. 10 can serve as a permanent plug at the ends of supporting bars 31, 32, 33. It has the same characteristics as guiding end piece 90, but it has a front side 910 that allows closing totally the opening of supporting bar 33 and it does not comprise side faces 93 of guiding end piece 90. It moreover comprises an additional entry zone 95, whose cross-section corresponds to that of additional joining zone 35 of supporting bar 33, located before said additional joining zone 35 when guiding end piece 900 is mounted on said supporting bar 33 (FIG. 10).

Figure 7:
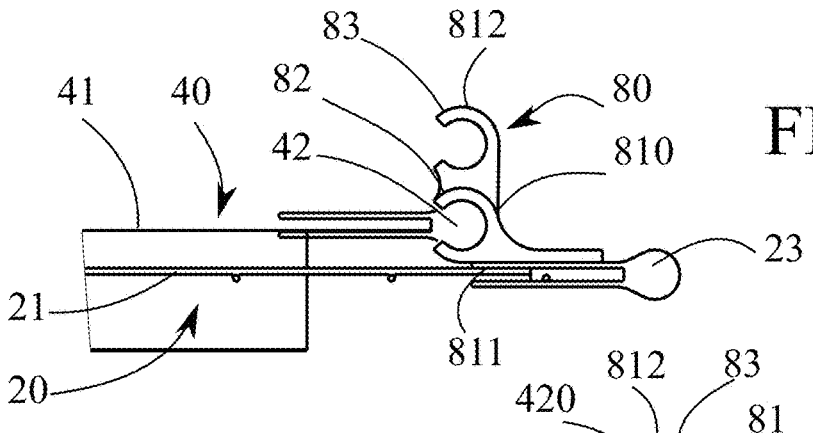
FIGS. 7 and 8 are side views of a transverse edge of a first tarpaulin element according to two embodiments allowing fastening a third tarpaulin element of a third covering tarpaulin superimposed on the second covering tarpaulin, which is itself superimposed on the first covering tarpaulin.
Figure 8:
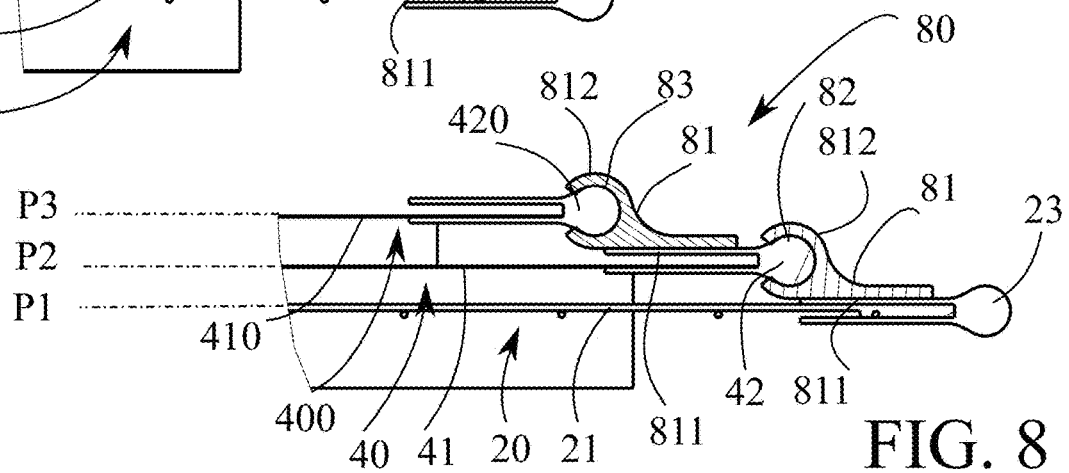

Covering device 10 according to the invention can be completed with a third modular covering tarpaulin 400, superimposed and substantially parallel to first and second covering tarpaulins 20, 40, to improve further its modularity and simplify the handling of the tarpaulin elements. Third joining zones can be added on supporting bars 31, 32, 33 to define a third parallel plane P3 above planes P1 and P2, or offset on tarpaulin elements 21, 41 to avoid increasing the cross-section of the supporting bars and consequently their weight. FIGS. 7 and 8 illustrate embodiment variants of fastening means 80 represented in FIG. 6, that allow adding easily a third covering tarpaulin 400 superimposed on second covering tarpaulin 40, itself superimposed on first covering tarpaulin 20. In these examples, third covering tarpaulin 400 is made, as first and second covering tarpaulins 20, 40, of third tarpaulin elements 410, arranged adjacently, aligned in a third plane P3 substantially parallel to second and first planes P2, P1, and joined to first tarpaulin elements 21 by fastening means 80. These third tarpaulin elements 410 are made of rectangular panels, of a width slightly smaller than the width of first tarpaulin elements 21. They comprise on their transverse edges joining elements 420 arranged to cooperate with third joining zones 83 having a complementary shape provided in fastening means 80 and allowing to realize a reversible assembly of third tarpaulin elements 410 with respect to second tarpaulin elements 41. This additional reversible assembly allows modifying easily the technical properties of covering device 10 without having to remove second tarpaulin elements 41. Typically, it is possible not to remove second tarpaulin elements 41, which advantageously provide the greenhouse effect and are used in the summer period, and to add preferably opaque third tarpaulin elements 410, for a short period of time, during a prolonged absence, or for the winter period, in order to prevent water overheating and/or algae proliferation.

Referring to FIG. 7, fastening means 80 comprise a fastening profile 810 that extends on all or on a part of the length of first tarpaulin elements 21, comprising a longitudinal wing 811 surmounted with a bead 812 provided with two superimposed joining zones 82, 83, corresponding to a second joining zone 82 to receive a second tarpaulin element 41 and to a third joining zone 83 to receive a third tarpaulin element 410. In FIG. 8, fastening means 80 correspond to those of FIG. 6, and comprise an additional fastening profile 81 that extends on all or on a part of the length of second tarpaulin elements 41 provided with a third joining zone 83 to receive a third tarpaulin element 410.

Possibilities for Industrial Application:

All elements making up modular and multipurpose covering device 10 of the invention can be produced by known manufacturing methods or use parts already existing on the market. Tarpaulin elements 21, 22, 41, 410 can in particular be cut to the desired length from one or several strips of material rolled up on a coil and whose width corresponds to the desired standard width. It is possible, when manufacturing the material strips and before preparing them in coils, to integrate joining elements 23, 42, 420 by attaching them on the longitudinal edges of every material strip, for example by thermowelding. The material panels obtained after cutting can easily be customized by adding flaps 25 at their ends according to the needs, these flaps 25 can have a chosen color different from the color of the material strip. For the joining methods illustrated in FIGS. 6, 7 and 8, one will add on first and/or second tarpaulin elements 21, 41 the necessary fastening profiles 81, 810 according to the chosen number of covering tarpaulins and joining technique. Else, one will use supporting bars 31, 32 provided with the four joining zones 34, 82.

This description shows clearly that the invention allows reaching the goals defined, that is to say offer a totally modular, versatile covering device that complies with the safety standards, obtained from simple, easily industrializable modules, which are joined by reversible sliding connections requiring no specific tooling. So, this covering device has a simple design, is easy to produce, package and store, cost-effective and rapid to implement.

Its modular design allows offering it for sale as a kit. In fact, covering device 10 can be supplied in modules comprising a number N of first tarpaulin elements 21 according to the desired length, a number N of second tarpaulin elements 41 chosen for a season or two sets of a number N of second tarpaulin elements 41 for the two seasons, or also a number N of second and third tarpaulin elements 41, 410 respectively for the summer season and for the winter season, a number N+1 of supporting bars 31, 32, 33, with or without pads 70, and the necessary number of lashing means 50 and tensioning means 60 according to the total width of covering device 10. If the desired length is not a multiple of the standard width of tarpaulin elements 21, 41, 410, this kit is completed with at least one end tarpaulin element 22 with the desired width.

The present invention is not restricted to the examples of embodiment described, but extends to any modification and variant which is obvious to a person skilled in the art.

The invention claimed is:

1. Modular and multipurpose covering device for a pool, comprising a first modular covering tarpaulin made of first tarpaulin elements arranged adjacently, aligned in a first plane and joined together by transverse supports in order to obtain a covering device with the desired length, said first tarpaulin elements comprising on their transverse edges joining elements arranged to cooperate with first joining zones having a complementary shape provided in said transverse supports and allowing to realize a reversible assembly of the first tarpaulin elements together, wherein said covering device further comprises a second modular covering tarpaulin, superimposed on first covering tarpaulin, and made of second tarpaulin elements with a width identical or slightly smaller than that of first tarpaulin elements, arranged adjacently, aligned in a second plane substantially parallel to first plane in which said first covering tarpaulin is extending, and assembled to first tarpaulin elements by fasteners, said second tarpaulin elements comprising on their transverse edges joining elements arranged to cooperate with second joining zones having a complementary shape provided on said fasteners and allowing to realize a reversible assembly of second tarpaulin elements with respect to first tarpaulin elements, and in that second covering tarpaulin has technical properties different from those of first covering tarpaulin.

2. Covering device according to claim 1, wherein said covering device further comprises a third modular covering tarpaulin, superimposed on first and second covering tarpaulins, and made of third tarpaulin elements with a width identical or slightly smaller than that of first and/or second tarpaulin elements, arranged adjacently, aligned in a third plane substantially parallel to first and second planes in which said first and second covering tarpaulin are respectively extending, and assembled to first and/or second tarpaulin elements by additional fasteners, said third tarpaulin elements comprising on their transverse edges joining elements arranged to cooperate with third joining zones having a complementary shape provided on said additional fasteners and allowing to realize a reversible assembly of third tarpaulin elements with respect to first and second tarpaulin elements, and in that third covering tarpaulin has technical properties different from those of first and second covering tarpaulins.

3. Covering device according to claim 1, wherein said fasteners of second and/or third tarpaulin elements are merged with said transverse supports and form one single part.

4. Covering device according to claim 1, wherein said transverse supports of said covering device are made each of a supporting bar having a cross-section symmetrical at least with respect to a median plane perpendicular to said first plane, said supporting bar comprising said first joining zones, arranged symmetrically with respect to said median plane and aligned in said first plane.

5. Covering device according to claim 4, wherein said supporting bar further comprises said second joining zones, arranged symmetrically with respect to said median plane and aligned in said second plane.

6. Covering device according to claim 5, wherein said supporting bar further comprises said third joining zones, arranged symmetrically with respect to said median plane and aligned in said second plane.

7. Covering device according to claim 1, wherein said fasteners of second and/or third tarpaulin elements are distinct from said transverse supports and form separate parts.

8. Covering device according to claim 7, wherein said fasteners comprise fastening profiles, integral with said second tarpaulin elements, extending on all or on a part of their length, parallel to each of their transverse edges, said fastening profiles comprising said second joining zones arranged in said second plane.

9. Covering device according to claim 8, wherein said fastening profiles further comprise said third joining zones, arranged in said third plane.

10. Covering device according to claim 8, wherein said fasteners further comprise additional fastening profiles, integral with said second tarpaulin elements, extending on all or on a part of their length, parallel to each of their transverse edges, said additional fastening profiles comprising said third joining zones arranged in said third plane.

11. Covering device according to claim 4, wherein said supporting bars further comprise an additional joining zone arranged in said median plane and in the lower section of said supporting bars.

12. Covering device according to claim 11, further comprising anti-wear pads arranged underneath said supporting bars and extending on all or on a part of their length, said pads comprising a joining element arranged to cooperate with said additional joining zone provided in said supporting bars, allowing to achieve an adjustable and reversible assembly of said pads.

13. Covering device according to claim 4, wherein said joining zones provided in said supporting bars and/or in said fastening profiles are formed by longitudinal grooves extending parallel to the longitudinal axis of said supporting bars and/or of said fastening profiles, and ending at their ends, and said joining elements provided on tarpaulin elements and/or on said pads comprise rods or bolt ropes having a shape complementary to said longitudinal grooves.

14. Covering device according to claim 13, further comprising guiding end pieces made of materials with a low friction coefficient and arranged to fit at the ends of said supporting bars to facilitate and guide the insertion of said joining elements of tarpaulin elements in said joining zones of the supporting bars.

15. Covering device according to claim 1, wherein said first covering tarpaulin is a safety cover, and wherein two of the transverse supports form end transverse supports assembled to the opposite ends of said first covering tarpaulin and coupled on one side with a lashing assembly and on the other side with a tensioning assembly arranged to secure said covering device to the ground when said covering device is placed above a pool.

16. Covering device according to claim 15, wherein said first covering tarpaulin comprises a receiver extending along its longitudinal edges to receive tensioning elements associated respectively with said lashing and tensioning assemblies of covering device when it is arranged above a pool, allowing holding said covering device down on the ground.

17. Covering device according to claim 16, wherein said first tarpaulin elements comprise on their longitudinal edges a slide that forms said receiver of first covering tarpaulin, and said tensioning elements coupled with lashing and tensioning assemblies are straps or rods passing in the successive slides of first tarpaulin elements up to the two end transverse supports.

18. Covering device according to claim 15, wherein said first covering tarpaulin further comprises at least one first tarpaulin end element arranged between one of said transverse supports and one of said end transverse supports, having a width different from that of first tarpaulin elements and/or having technical properties different from those of first tarpaulin elements.

19. Covering device according to claim 18, wherein said first tarpaulin end element has a width such that it allows covering by rolling up the whole of said covering device when it is rolled on itself in storage position.

20. Covering device according to claim 1, wherein said second covering tarpaulin and/or said third covering tarpaulin are arranged to add a greenhouse effect and/or a light filter effect to the safety function of said first covering tarpaulin.

21. Covering device according to claim 1, wherein said tarpaulin elements comprise at their four corners a buckle or an eyelet to receive a pulling strap that will facilitate the installation and removal of said tarpaulin elements with respect to said supporting bars.

22. Tarpaulin element for a covering device for a pool, said tarpaulin element being made of a rectangular panel with predefined width and length, forming a modular and interchangeable element of a modular and multipurpose covering device, said tarpaulin element comprising on its parallel transverse edges joining elements for cooperating with complementary joining zones provided in transverse supports and/or fasteners of said covering device when they are joined to form a covering tarpaulin, wherein said joining elements end before the ends of said tarpaulin element to allow said ends to rest naturally on the ground, and further comprising two end flaps that define its longitudinal edges and that are arranged to reinforce the longitudinal edges of said covering device obtained after joining and to facilitate the handling of said tarpaulin element.

23. Tarpaulin element according to claim 22, wherein said end flaps comprise a reversible fastener, chosen among buttons and hooks, arranged to fasten end flaps of a second tarpaulin element on end flaps of a first tarpaulin element.

24. Tarpaulin element according to claim 22, wherein it forms a first tarpaulin element having a safety function, it is made of a net whose meshes show a free area/mesh size ratio larger than 50%, and in that said end flaps comprise a receiver formed by a slide to receive straps or rods that form tensioning elements coupled with the lashing and tensioning assemblies of said covering device.

25. Tarpaulin element according to claim 22, wherein it forms a second tarpaulin element having a greenhouse effect function, and it is made of a flexible, transparent or translucent material, reinforced or not, with a solar factor g comprised between 60% and 100%.

26. Tarpaulin element according to claim 22, wherein it forms a third tarpaulin element having a light filter function and it is made of a flexible, opaque or semi-opaque material, reinforced or not, and in that said material is chosen to stop the wavelengths between 400 and 700 nm or the wavelengths between 280 and 310 nm.

27. Tarpaulin element according to claim 22, further comprising two fastening profiles extending on all or on a part of its length, parallel to each of its transverse edges, said fastening profiles comprising at least one joining zone extending in a plane parallel to said tarpaulin element, facing each other, intended for receiving the joining element of another tarpaulin element when they are assembled together in order to be superimposed.

28. Tarpaulin element according to claim 27, wherein said fastening profiles comprise two superimposed joining zones extending in two planes parallel to said tarpaulin element, facing each other, intended for receiving the joining element of two other tarpaulin elements when they are assembled together in order to be superimposed.

29. Transverse support for a covering device for a pool, said transverse support being made of a supporting bar having a cross-section symmetrical at least with respect to a median plane perpendicular to a first plane, and comprising first joining zones, arranged symmetrically with respect to said median plane and aligned in said first plane, intended for cooperating with complementary joining elements provided on the transverse edges of first tarpaulin elements to form a first covering tarpaulin, said supporting bar forming a modular and interchangeable element of a modular and multipurpose covering device according to claim 1, further comprising second joining zones, arranged symmetrically with respect to said median plane and aligned in a second plane parallel to said first plane, intended for cooperating with complementary joining elements provided on the transverse edges of second tarpaulin elements when they are assembled, to realize a reversible assembly of second tarpaulin elements with respect to first tarpaulin elements and form a second covering tarpaulin superimposed on first covering tarpaulin.

30. Transverse support according to claim 29, wherein said supporting bars further comprise third joining zones, arranged symmetrically with respect to said median plane and aligned in a third plane parallel to said first plane, for cooperating with complementary joining elements provided on the transverse edges of third tarpaulin elements when they are assembled, to realize a reversible assembly of third tarpaulin elements with respect to first and second tarpaulin elements and form a third covering tarpaulin superimposed on second covering tarpaulin.

31. Transverse support according to claim 29, wherein said supporting bars further comprise an additional joining zone arranged in said median plane and in the lower section of said supporting bars, for cooperating with an additional joining element provided on anti-wear pads when they are assembled.

* * * * *